US008936032B2

(12) United States Patent
Goodson

(10) Patent No.: US 8,936,032 B2
(45) Date of Patent: Jan. 20, 2015

(54) ULTRASONIC AIR BLANKET REFLECTOR

(75) Inventor: J. Michael Goodson, Skillman, NJ (US)

(73) Assignee: Crest Oil & Gas, Inc., Trenton, NJ (US)

( * ) Notice: Subject to any disclaimer, the term of this patent is extended or adjusted under 35 U.S.C. 154(b) by 0 days.

(21) Appl. No.: 13/463,770

(22) Filed: May 3, 2012

(65) Prior Publication Data

US 2012/0279531 A1 Nov. 8, 2012

Related U.S. Application Data

(60) Provisional application No. 61/482,093, filed on May 3, 2011.

(51) Int. Cl.
*B08B 3/12* (2006.01)
*G10K 11/20* (2006.01)

(52) U.S. Cl.
CPC ..... *B08B 3/12* (2013.01); *G10K 11/205* (2013.01)
USPC ..... 134/184

(58) Field of Classification Search
CPC ..... B08B 3/044; B08B 3/12
USPC ..... 134/1, 84, 184
See application file for complete search history.

(56) References Cited

U.S. PATENT DOCUMENTS

| | | | | |
|---|---|---|---|---|
| 1,382,104 A * | 6/1921 | McCarthy | 261/114.1 |
| 2,381,386 A * | 8/1945 | Kuhn | 413/1 |
| 3,001,532 A * | 9/1961 | Plassmeyer | 134/108 |
| 3,564,775 A * | 2/1971 | Bodine | 451/113 |
| 4,194,510 A | 3/1980 | Proudian | |
| 5,090,430 A | 2/1992 | Nixon | |
| 5,119,676 A | 6/1992 | Bower | |
| 2004/0191275 A1 | 9/2004 | Milner | |
| 2010/0018309 A1 | 1/2010 | Marcovecchio et al. | |

FOREIGN PATENT DOCUMENTS

| | | | |
|---|---|---|---|
| JP | 2004-221343 A | | 8/2004 |
| JP | 2006007104 A | * | 1/2006 |
| KR | 2003056562 A | * | 7/2003 |
| WO | WO 2010-038052 A1 | | 4/2010 |

OTHER PUBLICATIONS

Machine Translation of Tonogaki et al., JP 2006007104 A, Jan. 2006.*

Machine Translation of Ryoo J I et al., KR 2003-056562A, Jul. 2003.*

PCT/US2012/036389 (1153540.00137) International Search Report and Written Opinion dated Aug. 17, 2012.

AU2012250676 Examination Report issued Jul. 19, 2014.

* cited by examiner

*Primary Examiner* — David Cormier
(74) *Attorney, Agent, or Firm* — K&L Gates LLP

(57) ABSTRACT

An air blanket reflector, which is placed inside and next to the walls of an ultrasonic tank, reflects ultrasonic energy. The air blanket reflector has a relatively thin metal plate, such as 14 gauge stainless steel, facing the interior of the tank and an air-filled cavity on the opposite side of the thin metal plate. The thin metal plate reflects ultrasonic energy away from the walls of the tank to reduce the amount of ultrasonic energy absorbed by the tank.

8 Claims, 3 Drawing Sheets

ULTRASONIC AIR BLANKET REFLECTOR

RELATED APPLICATION

The present application claims the benefit of U.S. Provisional Patent Application 61/482,093, which was filed on May 3, 2011, entitled "ULTRASONIC AIR BLANKET REFLECTOR" and invented by J. Michael Goodson. This prior application is expressly incorporated herein by reference.

FIELD OF THE INVENTION

This invention relates generally to tanks for ultrasonic processing, and relates more particularly to a reflective structure added to a tank to improve reflection and decrease absorption of ultrasonic energy by the tank.

BACKGROUND OF THE INVENTION

Ultrasonic cleaning processes typically use metal tanks that contain a liquid and parts to be cleaned. Ultrasonic energy is supplied to the tank by ultrasonic transducers, which may be attached to or immersed in the tank. The walls and floor of the tank are typically 0.25 inch or 8 gauge or 10 gauge stainless steel. The walls and floor of the tank absorb some of the ultrasonic energy produced by the ultrasonic transducers, which decreases the amount of ultrasonic energy that can be employed in the cleaning processes.

It is known that ultrasonic vibrations used to excite liquids bounce off metal if there is air on the other side of the metal and the metal is relatively thin. For example with air on the other side of 14 gauge steel, ultrasonic activity has been measured to bounce off nine times more effectively than with 0.25 inch steel. The ultrasonic vibrations are reflected rather than absorbed by a thin metal panel backed with air. However, it is not practical to fabricate tanks out of 14 gauge metal because relatively thicker materials are needed for structural integrity and durability.

SUMMARY OF THE INVENTION

The present invention is an air blanket reflector that is placed inside an ultrasonic tank, at or near the walls of the tank, for reflecting ultrasonic energy. The air blanket reflector has a relatively thin metal plate, such as 14 gauge stainless steel, facing the interior of the tank and an air-filled cavity on the opposite side of the thin metal plate.

More specifically, the invention is a processing apparatus that includes (1) a tank for containing a liquid and one or more parts to be processed, where the tank has one or more walls; (2) one or more ultrasonic transducers for providing ultrasonic energy to the interior of the tank; and (3) an air blanket reflector located adjacent to one or more walls of the tank. The air blanket reflector includes a face panel oriented toward the interior of the tank and a cavity containing no liquid located between the face panel and the wall of the tank. The thickness of the face panel is less than the thickness of the walls of the tank.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENTS

The drawings depict various preferred embodiments of the present invention for purposes of illustration only. One skilled in the art will readily recognize from the following discussion that alternative embodiments of the structures and methods illustrated herein may be employed without departing from the principles of the invention described herein.

An air blanket reflector, according to the present invention, is a structure that is placed inside an ultrasonic tank, at or near the walls of the tank. The air blanket reflector has a relatively thin metal panel, such as 14 gauge (0.0781 inch) stainless steel, facing the interior of the tank and a cavity or pockets filled with air on the opposite side of the thin metal panel.

Figure 1:
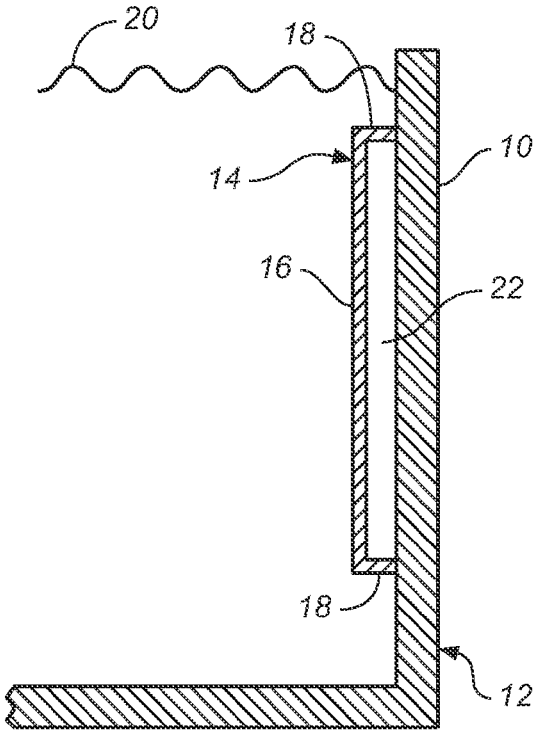
FIG. 1 is a sectional view of a corner of a tank with a fixed air blanket reflector according to the invention.
Figure 2:
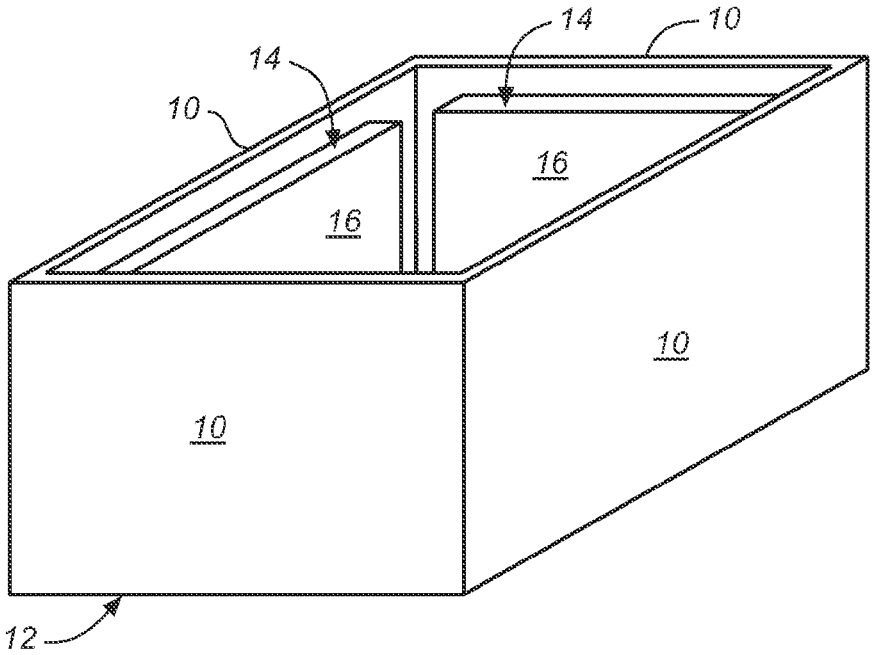
FIG. 2 is a perspective view of a tank with air blanket reflectors attached to or mounted at the walls of the tank.
Figure 3:
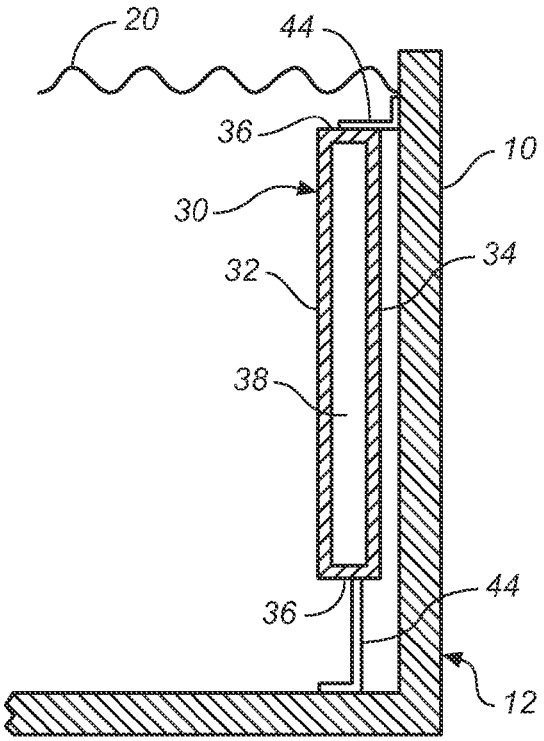
FIG. 3 is a sectional view of a corner of a tank with a removable air blanket reflector according to the invention.

One embodiment of the air blanket reflector, as shown in FIGS. 1 and 2, is attached to a wall 10 of a tank 12 under the surface 20 of liquid in the tank. The air blanket reflector 14 has a metal panel 16, preferably composed of 14 gauge stainless steel. The edges of the metal panel 16 have flanges 18 that are attached to the tank wall 10, forming a cavity 22 between the metal panel 16 and the tank wall 10. The cavity is preferably about 0.25 to 0.375 inch in depth between the inside of the metal panel 16 and the tank wall 10. The flanges 18 of the air blanket reflector 14 are preferably welded to the tank wall 10 around all sides of the reflector. The metal panel 16 of the air blanket reflector 14 reflects ultrasonic vibrations back into the interior of the tank better than the thicker tank wall, which tends to absorb the ultrasonic vibrations. The tank walls are preferably 0.25 inch or 8 gauge (0.1719 inch) or 10 gauge (0.1406 inch) stainless steel.

The air blanket reflector should cover a significant portion of the side walls of the tank in order to efficiently reflect ultrasonic vibrations that would otherwise be absorbed by the tank walls. The air blanket reflector may also be used near the bottom of the tank to reflect ultrasonic vibrations that would otherwise be absorbed by the bottom. The air blanket reflector is most useful when the ultrasonic vibrations are generated inside the tank, such as with rod type transducers that are immersed inside the tank. However, the air blanket reflector can also be used with transducers mounted on a surface of the tank, such as the bottom or a side wall, in which case an air blanket reflector would not be mounted adjacent to that surface.

The cavity behind the metal panel of the air blanket reflector is preferably filled with unpressurized air and is sealed so that the liquid inside the tank does not enter the cavity. Other gases, such as nitrogen, for example, could be used instead to fill the cavity. Although the illustrated embodiments of the air blanket reflector show the reflector to be under the surface of the liquid, the reflector could extend upward above the level of the liquid and could provide venting at the top of the cavity. What is important is that there is air or another gas inside the cavity. Since the cavity needs to be filled with a gas for the reflector to operate properly, any liquid inside will reduce the effectiveness of the reflector and should be avoided.

Figure 4:
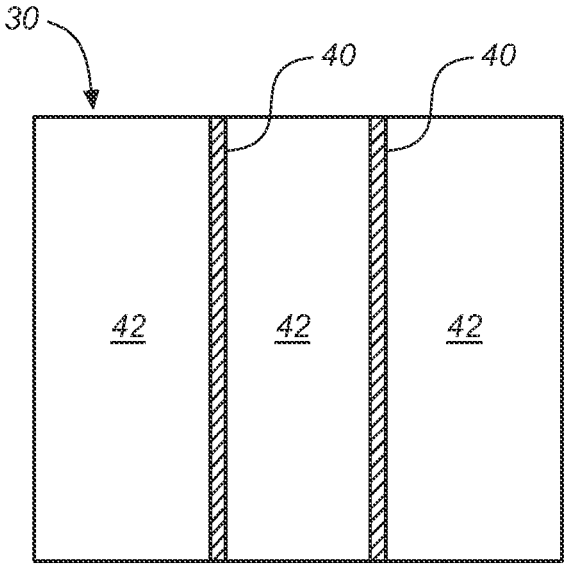
FIG. 4 is a sectional view of the removable air blanket reflector.
Figure 5:
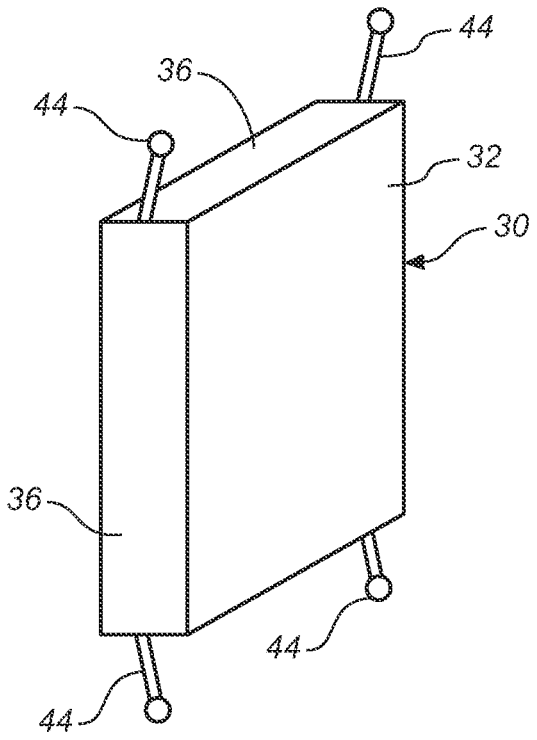
FIG. 5 is a perspective view of the removable air blanket reflector.
Figure 6:
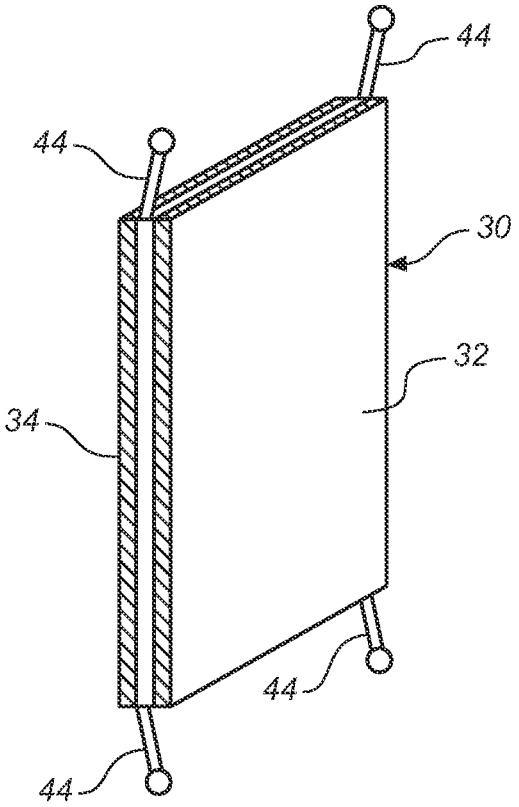
FIG. 6 is a perspective view of the removable air blank reflector shown in section.

Another embodiment of the air blanket reflector, as shown in FIGS. 3-6, is an air blanket reflector 30 that hangs inside the tank 12 near the tank wall 10 under the surface 20 of liquid in the tank. The air blanket reflector 30 has two metal panels, 32 and 34, and perimeter walls 36 that form a sealed cavity 38, preferably containing air. Preferably at least the outer metal panel 32 of the air blanket reflector 30 is composed of 14 gauge stainless steel. The cavity 38 is preferably about 0.25 to 0.375 inch in depth between the inside surfaces of the metal panels 32 and 34. Internal ribs 40 may be used inside the cavity 38 for supporting the metal panels. The internal ribs 40 are spaced apart, preferably by about 12 inches, and divide the cavity 38 into several pockets 42, as shown in FIG. 4. The air blanket reflector can be fabricated from flat plates by welding. Mounting brackets 44 are used to mount the air blanket reflector 30 inside a tank. Preferably, four brackets 44 are used at the corners of the air blanket reflector 30 to anchor it to the bottom or wall of the tank. FIG. 6 is a perspective view of the air blanket reflector 30 similar to FIG. 5, but the metal faces 32 and 34 are shown in section. Since this embodiment of the air blanket reflector is mounted with brackets, it is easier to remove from the tank than the embodiment shown in FIGS. 1 and 2, which is welded to the tank.

In applications using rod-type ultrasonic transducers with powerful low frequency thickness mode ultrasonics, use of the ultrasonic air blanket reflector has the advantage of 14 gauge metal for reflecting sound but the strength of thicker metals, e.g., 10 and 8 gauge stainless steel or even stronger 0.25 inch stainless steel, for an effective tank. The air blanket reflector is useful for ultrasonic applications such as cleaning heat exchangers in refineries, cleaning dairy equipment, cleaning pulp processing equipment, and for pharmaceutical applications. Additionally the same technology can be used for cleaning automobile and truck frames, large motors, oil and gas drilling tools and other large objects. The invention is relatively inexpensive and simple to manufacture.

From the above description, it will be apparent that the invention disclosed herein provides a novel and advantageous air blanket reflector for ultrasonic tanks The foregoing discussion discloses and describes merely exemplary methods and embodiments of the present invention. As will be understood by those familiar with the art, the invention may be embodied in various other forms without departing from the spirit or essential characteristics thereof. Accordingly, the disclosure of the present invention is intended to be illustrative, but not limiting, of the scope of the invention, which is set forth in the following claims.

The invention claimed is:

1. A processing apparatus comprising:

a stationary tank having at least one wall, wherein the tank defines an interior for containing a liquid and one or more parts to be processed;

one or more ultrasonic transducers for providing ultrasonic energy to the interior of the tank;

an air blanket reflector located adjacent to and in closest proximity with an adjacent wall of the tank and directly mounted to the adjacent wall for reflecting ultrasonic energy that would otherwise hit the adjacent wall, wherein the adjacent wall of the tank has a uniform thickness, wherein the air blanket reflector includes a first face panel oriented toward the interior of the tank and a cavity containing no liquid located between the face panel and the adjacent wall of the tank, wherein the first face panel is substantially parallel to the adjacent wall of the tank, wherein the first face panel has a uniform thickness and has a uniform surface exposed to the interior of the tank, and wherein the uniform thickness of the first face panel is less than the uniform thickness of the adjacent wall of the tank.

2. A processing apparatus as recited in claim 1, wherein the air blanket reflector includes flanges around the perimeter of the first face panel that are attached to the adjacent wall of the tank, and wherein the cavity is formed between the first face panel and the adjacent wall of the tank.

3. A processing apparatus as recited in claim 2, wherein the flanges are welded to the adjacent wall of the tank.

4. A processing apparatus as recited in claim 1, wherein the air blanket reflector includes a second face panel parallel to and spaced apart from said first face panel, and wherein the cavity is formed between the first and second face panels.

5. A processing apparatus as recited in claim 4, wherein the air blanket reflector includes walls around the perimeter of the first and second face panels, and wherein the perimeter walls are welded to the first and second face panels.

6. A processing apparatus as recited in claim 4, wherein the air blanket reflector is attached to the tank with brackets.

7. A processing apparatus as recited in claim 1, wherein the cavity contains air.

8. A processing apparatus as recited in claim 1, wherein the first face panel is composed of 14 gauge stainless steel and the adjacent wall of the tank is composed of 10 gauge or thicker stainless steel.

* * * * *